US012708214B1

(12) United States Patent
Cabale et al.

(10) Patent No.: US 12,708,214 B1
(45) Date of Patent: Aug. 18, 2026

(54) POPCORN BAG CUP HOLDER INSERT

(71) Applicants: Eileen Cabale, Las Vegas, NV (US); Elyssa Rodriguez, Las Vegas, NV (US)

(72) Inventors: Eileen Cabale, Las Vegas, NV (US); Elyssa Rodriguez, Las Vegas, NV (US)

( * ) Notice: Subject to any disclaimer, the term of this patent is extended or adjusted under 35 U.S.C. 154(b) by 0 days.

(21) Appl. No.: 19/270,601

(22) Filed: Jul. 16, 2025

(51) Int. Cl.
*A47C 7/62* (2006.01)

(52) U.S. Cl.
CPC ..... *A47C 7/624* (2018.08)

(58) Field of Classification Search
CPC ..... A47C 7/624; A47C 7/622
USPC ..... 220/694, 720, 722, 729, 480, 481, 737, 220/742, 907
See application file for complete search history.

(56) References Cited

U.S. PATENT DOCUMENTS 5,720,516 A * 2/1998 Young ..... A47C 7/68 297/188.14
6,109,580 A 8/2000 Stern
6,533,233 B2 3/2003 Thomas
D529,766 S 10/2006 Cunningham
8,967,381 B2 3/2015 Cassese
10,220,980 B2 * 3/2019 Randazzo ..... A47G 19/02
2003/0218013 A1 * 11/2003 Altman ..... B65D 21/08 220/4.03
2006/0118453 A1 6/2006 Hillebrecht
2008/0078773 A1 * 4/2008 Cassese ..... B65D 81/3446 220/737
2014/0183204 A1 * 7/2014 Kao ..... A47G 19/06 220/737
2015/0201779 A1 * 7/2015 Tittel ..... A45F 3/20 220/737
2021/0101514 A1 * 4/2021 Matteucci ..... B60N 3/105

FOREIGN PATENT DOCUMENTS

CA 2358236 9/2009
CN 203934991 * 11/2014

* cited by examiner

*Primary Examiner* — Rafael A Ortiz
(74) *Attorney, Agent, or Firm* — Kyle A. Fletcher, Esq.

(57) ABSTRACT

The popcorn bag cup holder insert may include an extendable base, a top panel, and a bottom panel. The top panel may adhere to the underside of a popcorn container to hold the popcorn bag cup holder insert onto the popcorn container. The extendable base may include a plurality of collapsible sections that May convert between a collapsed configuration and an extended configuration. In the extended configuration, the extendable base may be inserted into a cup holder of an arm rest in order to retain the popcorn container on the arm rest. A pull tab located on the bottom panel may be adapted to be grasped and pulled by a user to move the plurality of collapsible sections from the collapsed configuration to the extended configuration. As non-limiting examples, the popcorn container may be a bucket, a bag, or a bowl.

20 Claims, 7 Drawing Sheets

POPCORN BAG CUP HOLDER INSERT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of containers for popcorn serving and cup holder inserts, more specifically, a popcorn bag cup holder insert.

SUMMARY OF INVENTION

The popcorn bag cup holder insert may comprise an extendable base, a top panel, and a bottom panel. The top panel may adhere to the underside of a popcorn container to hold the popcorn bag cup holder insert onto the popcorn container. The extendable base may comprise a plurality of collapsible sections that may convert between a collapsed configuration and an extended configuration. In the extended configuration, the extendable base may be inserted into a cup holder of an arm rest in order to retain the popcorn container on the arm rest. A pull tab located on the bottom panel may be adapted to be grasped and pulled by a user to move the plurality of collapsible sections from the collapsed configuration to the extended configuration. As non-limiting examples, the popcorn container may be a bucket, a bag, or a bowl.

An object of the invention is to provide an extendable base that ay be coupled to the bottom of a popcorn container.

Another object of the invention is to provide an extendable base that collapses to a collapsed configuration and extends to an extended configuration.

A further object of the invention is to provide an extendable base that may be inserted into a cup holder of an arm rest when in the extended configuration such that the extendable base may retain the popcorn container on the arm rest.

Yet another object of the invention is to provide a pull tab on the bottom of the extendable base to aid in extending the extendable base.

These together with additional objects, features and advantages of the popcorn bag cup holder insert will be readily apparent to those of ordinary skill in the art upon reading the following detailed description of the presently preferred, but nonetheless illustrative, embodiments when taken in conjunction with the accompanying drawings.

In this respect, before explaining the current embodiments of the popcorn bag cup holder insert in detail, it is to be understood that the popcorn bag cup holder insert is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the popcorn bag cup holder insert.

It is therefore important that the claims be regarded as including such equivalent construction insofar as they do not depart from the spirit and scope of the popcorn bag cup holder insert. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
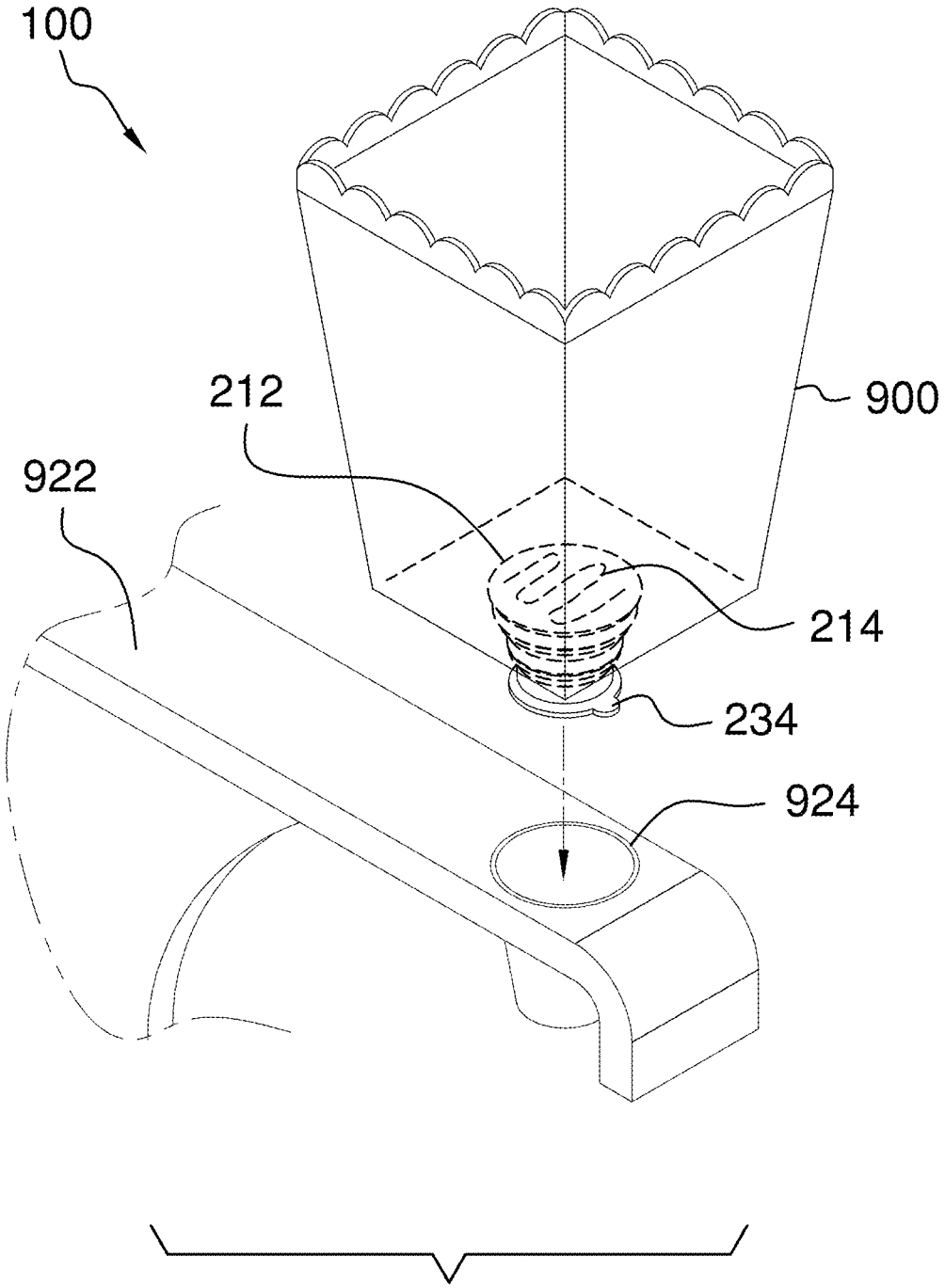
FIG. 1 is an isometric in-use view of an embodiment of the disclosure, illustrating the invention coupled a popcorn bucket.
Figure 2:
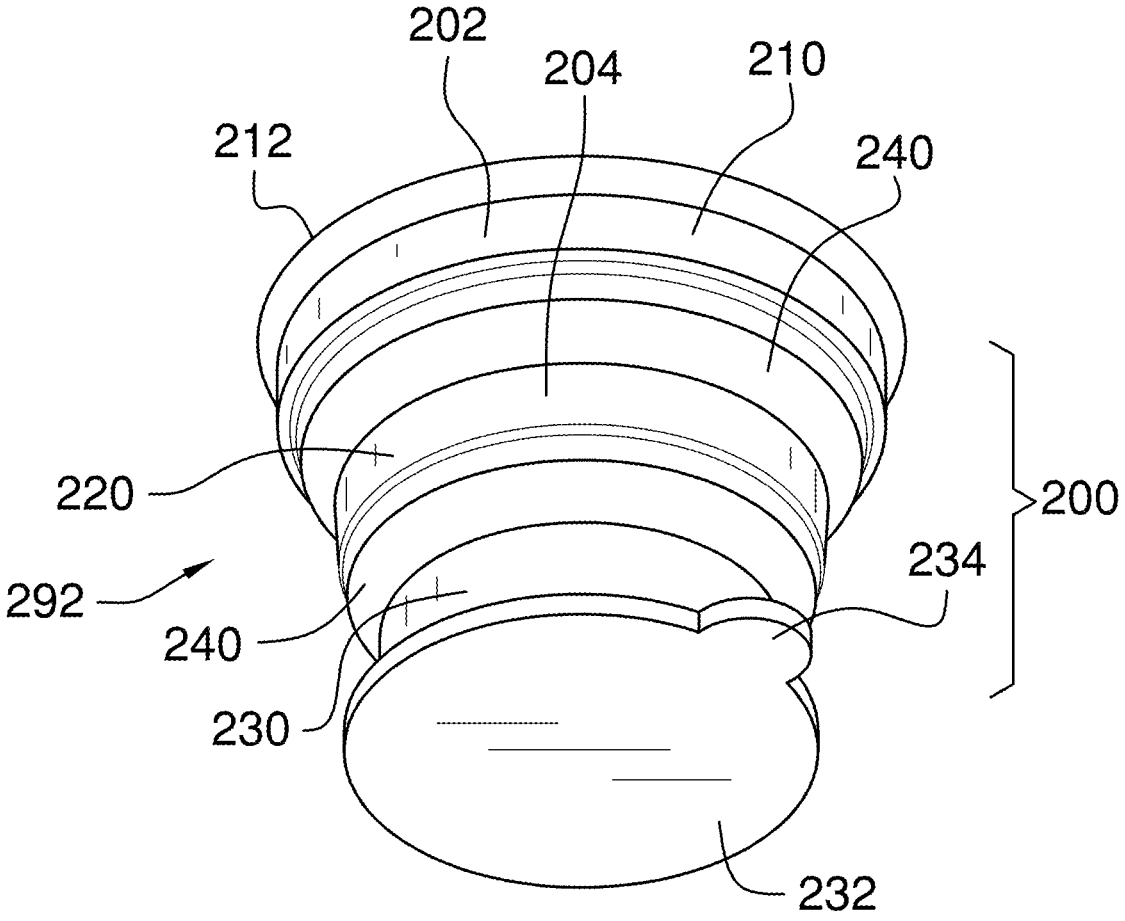
FIG. 2 is a bottom isometric view of an embodiment of the disclosure.
Figure 3:
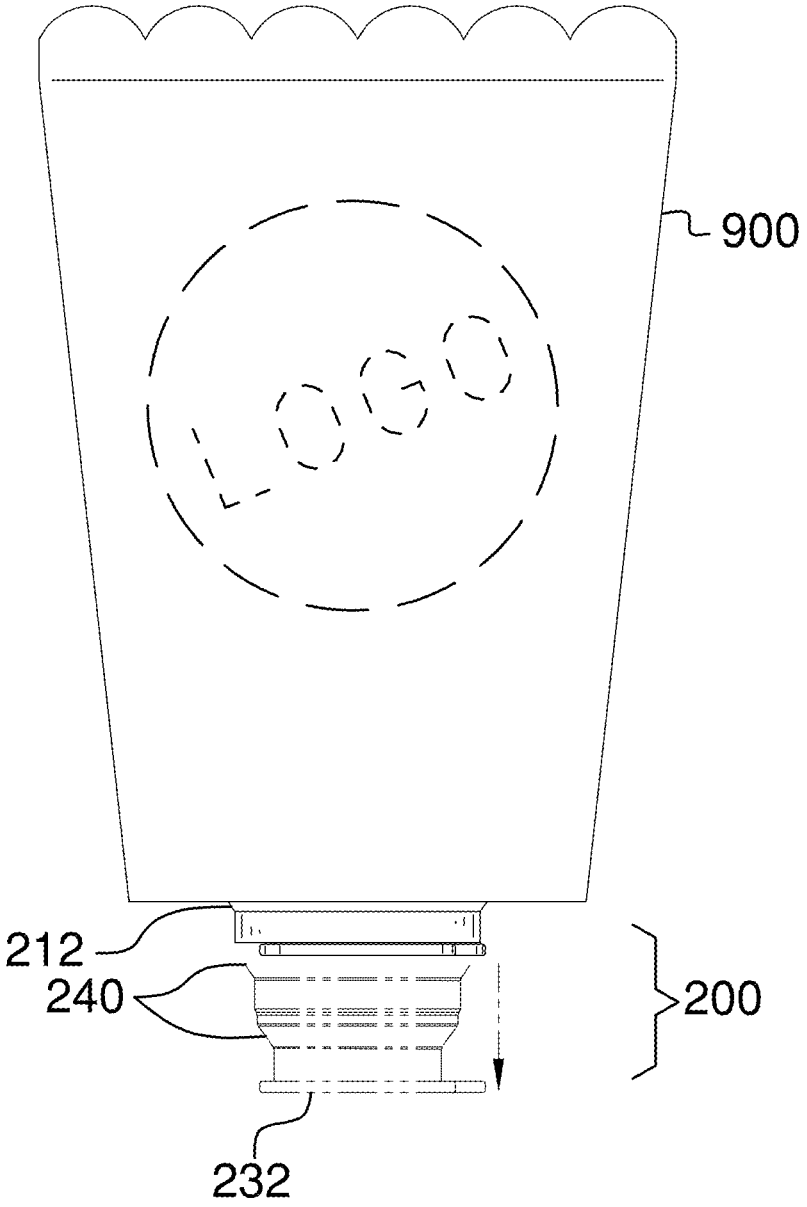
FIG. 3 is a front view of an embodiment of the disclosure, illustrating the invention coupled a popcorn bucket.
Figure 4:
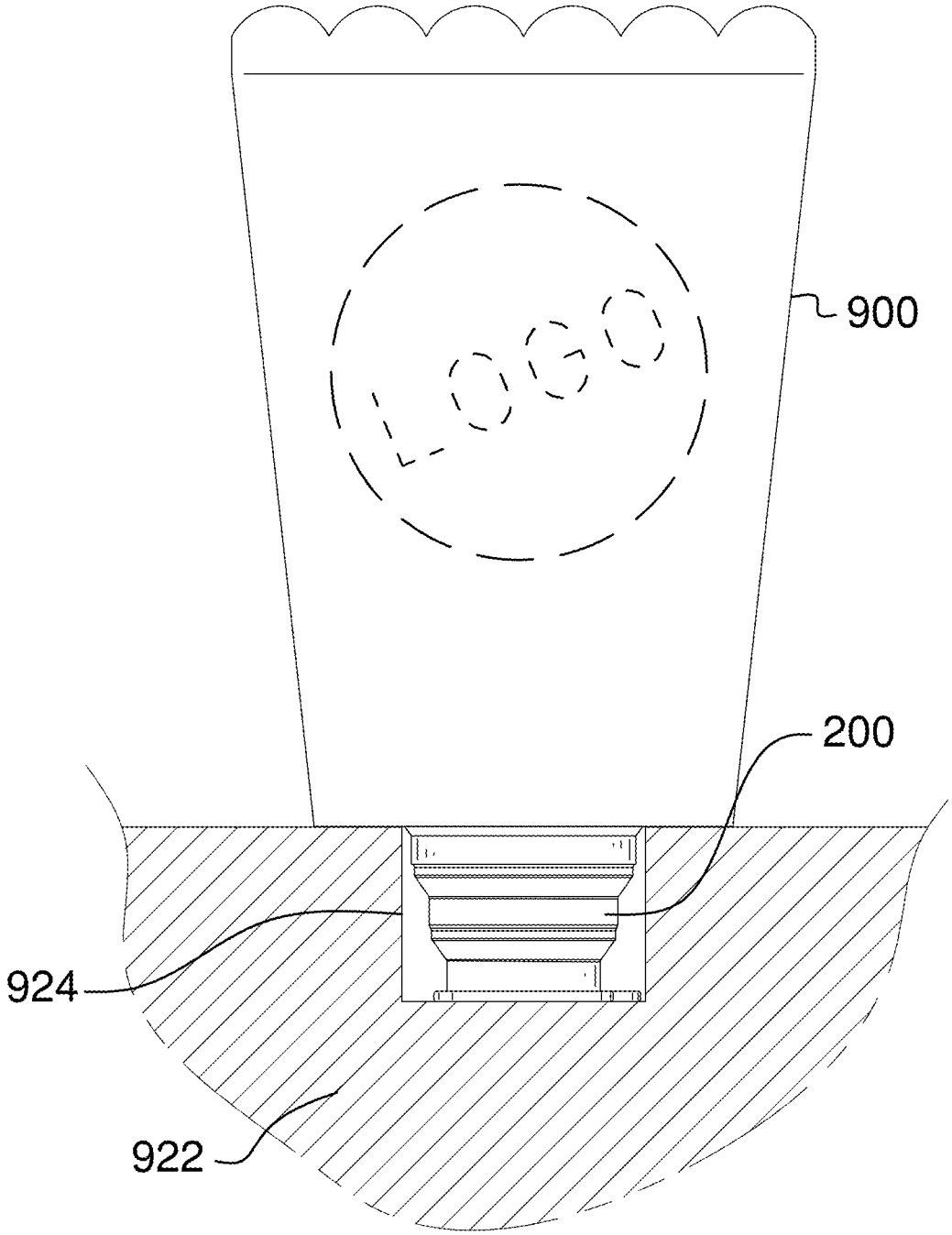
FIG. 4 is a front in-use view of an embodiment of the disclosure.
Figure 5:
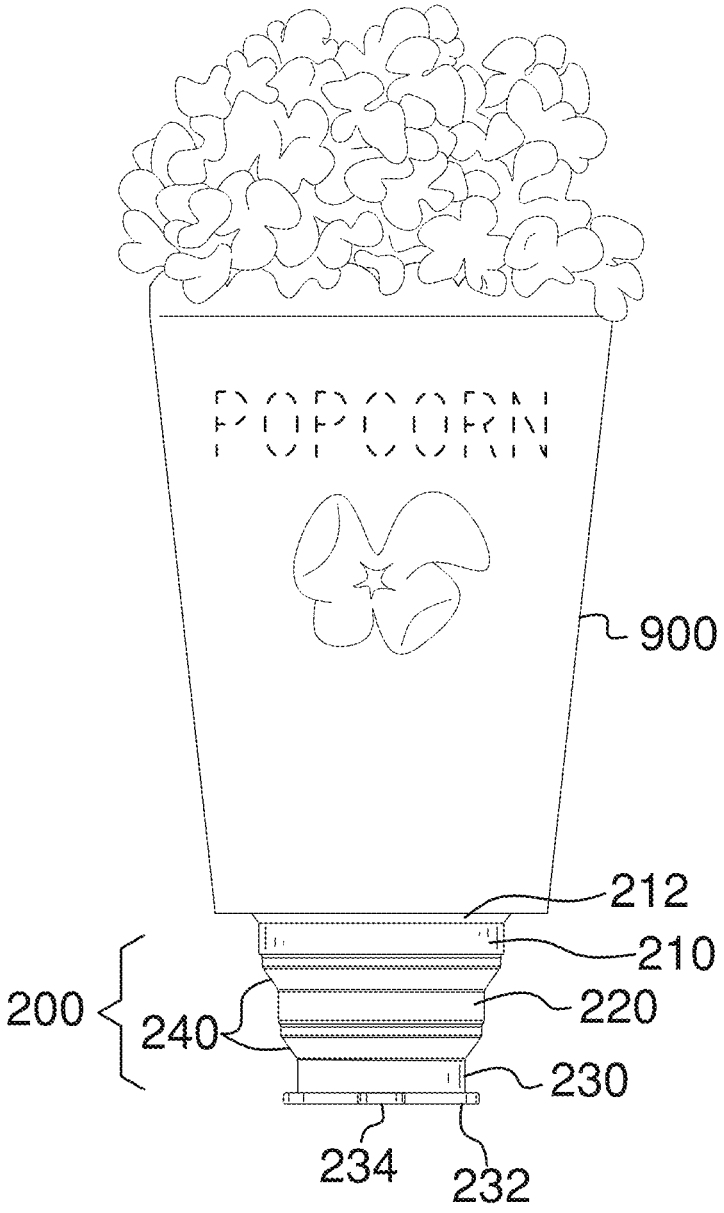
FIG. 5 is a side in-use view of an embodiment of the disclosure, illustrating the invention coupled a popcorn bucket.
Figure 6:
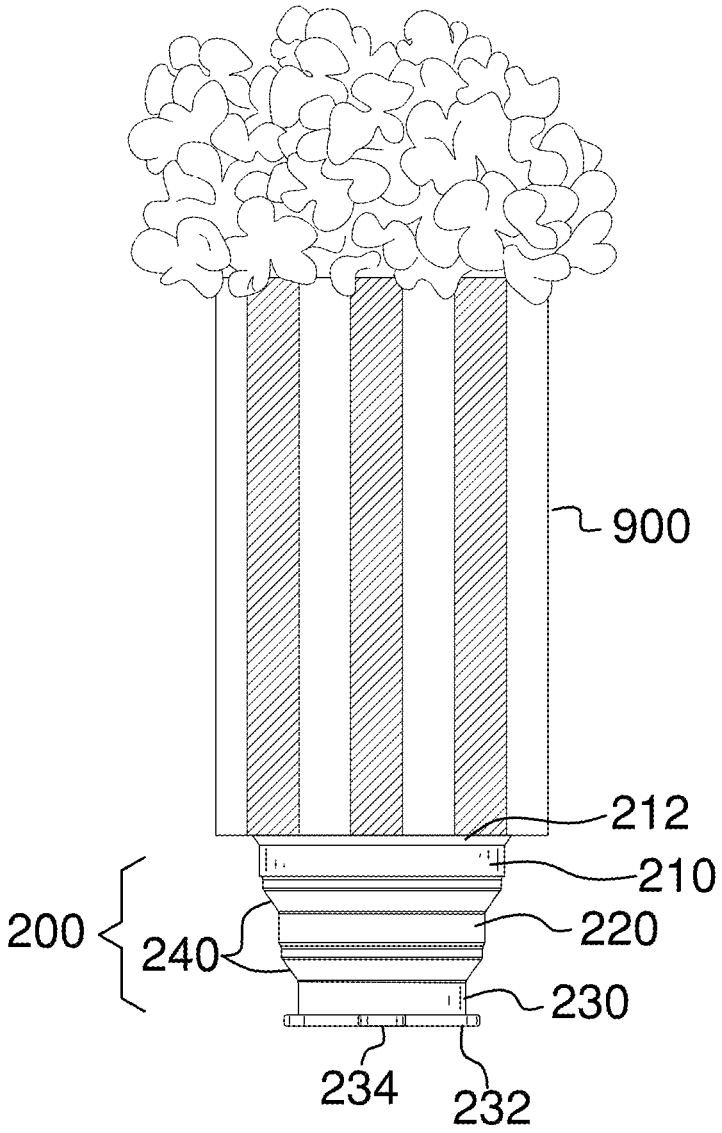
FIG. 6 is a side in-use view of an embodiment of the disclosure, illustrating the invention coupled a popcorn bag.
Figure 7:
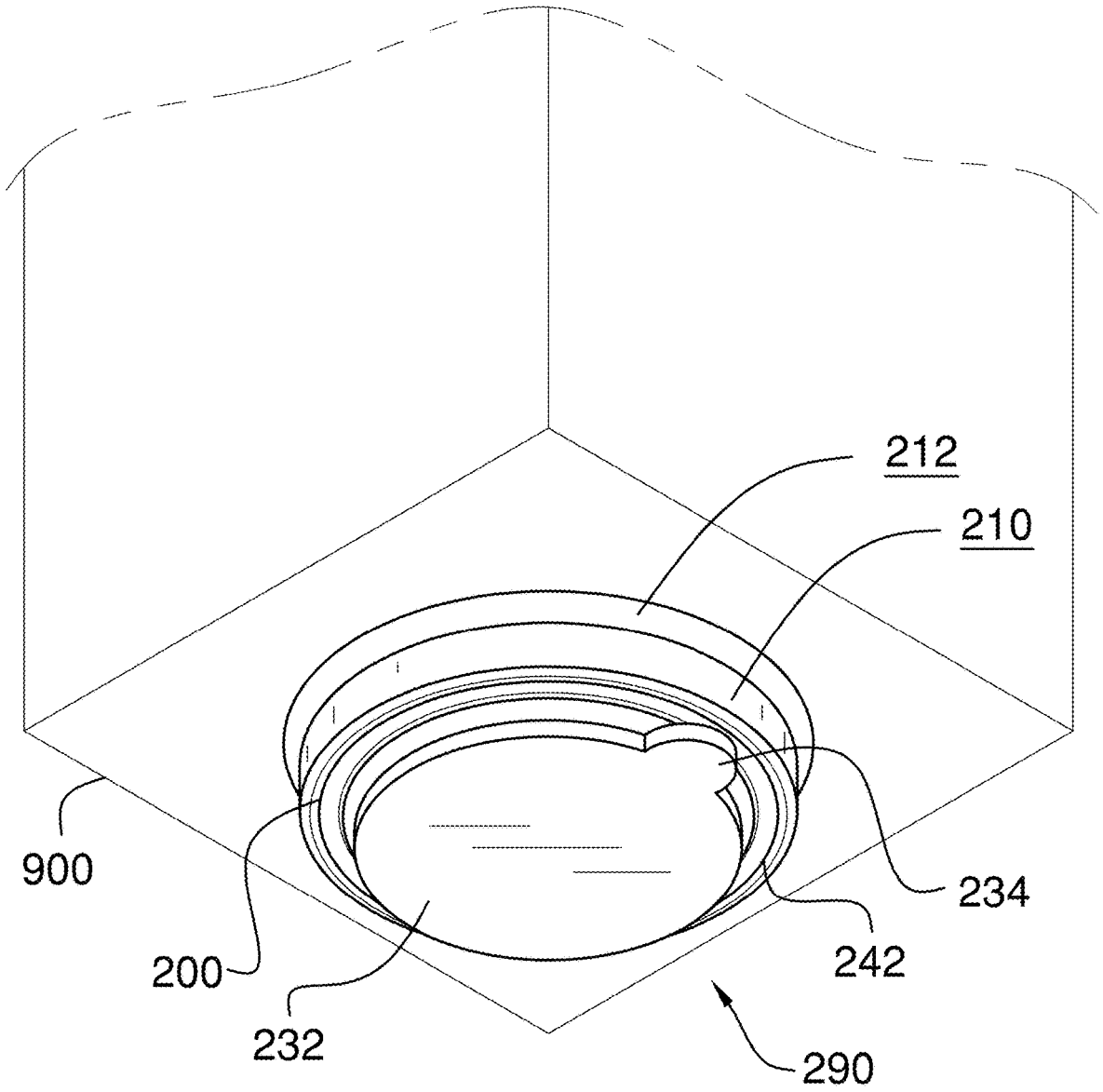
FIG. 7 is a bottom isometric view of an embodiment of the disclosure.

Detailed reference will now be made to a first potential embodiment of the disclosure, which is illustrated in FIG. 1 through 7.

The popcorn bag cup holder insert 100 (hereinafter invention) comprises an extendable base 200, a top panel 212, and a bottom panel 232. The top panel 212 may adhere to the underside of a popcorn container 900 to hold the invention 100 onto the popcorn container 900. The extendable base 200 may comprise a plurality of collapsible sections that may convert between a collapsed configuration 290 and an extended configuration 292. In the extended configuration 292, the extendable base 200 may be inserted into a cup holder 924 of an arm rest 922 in order to retain the popcorn container 900 on the arm rest 922. A pull tab 234 located on the bottom panel 232 May be adapted to be grasped and pulled by a user to move the plurality of collapsible sections from the collapsed configuration 290 to the extended configuration 292. As non-limiting examples, the popcorn container 900 may be a bucket, a bag, or a bowl.

The extendable base 200 may comprise the plurality of collapsible sections that may be deployed to the extended configuration 292 in order to form an insert for the cup holder 924. The extendable base 200 may resemble a frustum of a cone when in the extended configuration 292. The plurality of collapsible sections may be hollow such that the plurality of collapsible sections may telescopically collapse to form the collapsed configuration 290. The plurality of collapsible sections may be movably coupled by a plurality of section couplers 240.

The plurality of collapsible sections may comprise a top section 210, one or more intermediate sections 220, and a bottom section 230. The top section 210 may have the largest diameter of the plurality of collapsible sections. The diameters of the plurality of collapsible sections may decrease sequentially at lower levels of the plurality of collapsible sections. The bottom section 230 may have the smallest diameter.

In some embodiments, the extendable base 200 may adjust to the size of the cup holder 924 by virtue of pulling more or fewer of the plurality of collapsible sections downward. As a non-limiting example, the uppermost of the plurality of collapsible sections may rest on top of the arm rest 922 while the lowest of the plurality of collapsible sections extend down into the cup holder 924.

The top panel 212 may cover the top of the top section 210 such that the top of the top section 210 is closed. The top panel 212 may form a horizontal surface that may be coupled to the bottom of the popcorn container 900. The top surface of the top panel 212 may comprise an adhesive layer 214 that may be operable to couple the top panel 212 to the popcorn container 900. In some embodiments, the adhesive layer 214 may be covered by a backing liner that may cover the adhesive layer 214. The backing liner may be removed to expose the adhesive layer 214 when it is desirable to couple the top panel 212 to the popcorn container 900.

The one or more intermediate sections 220 may couple the top section 210 to the bottom section 230 such that the plurality of collapsible sections may telescopically collapse and extend. The bottom panel 232 may cover the bottom of the bottom section 230 such that the bottom of the bottom section 230 is closed. The bottom panel 232 may comprise the pull tab 234 that may be adapted to be grasped and pulled by the user while extending and/or collapsing the extendable base 200.

The plurality of collapsible sections may be movably coupled by the plurality of section couplers 240. Two adjacent sections selected from the plurality of collapsible sections May be coupled by an individual section coupler such that a lower section 204 may move axially relative to an upper section 202. As a non-limiting example, the individual section coupler may be a living hinge 242 that couples the bottom of the upper section 202 to the top of the lower section 204. In the extended configuration 292, the lower section 204 may be positioned below the upper section 202 with the individual section coupler extending down from a bottom rim of the upper section 202 to an upper rim of the lower section 204. In the collapsed configuration 290, the lower section 204 may be positioned at least partially within the upper section 202 with the individual section coupler extending up from a bottom rim of the upper section 202 to an upper rim of the lower section 204.

In the extended configuration 292, the plurality of collapsible sections may be unnested such that the extendable base 200 achieves maximum vertical height. In the collapsed configuration 290, the plurality of collapsible sections may be nested such that the extendable base 200 achieves minimum vertical height.

In a preferred embodiment, there may be three collapsible sections comprising the top section 210, one intermediate section, and the bottom section 230.

In some embodiments, the invention 100 may be coupled to the popcorn container 900 prior to distribution such that the popcorn container 900 and the invention 100 are distributed as a single unit-ready for use.

In some embodiments, the invention 100 may be distributed separately from the popcorn container 900 such that the invention 100 may be coupled to the popcorn container 900 at the time of use.

In use, the extendable base 200 may be coupled to the bottom of the popcorn container 900 by adhering the adhesive layer 214 on the top of the top panel 212 to the bottom of the popcorn container 900. This step may be performed at the time that the popcorn is sold or as a step in the manufacturing process of the popcorn container 900. The popcorn container 900 may then be filled with a popcorn. A user may take the popcorn container 900 to a seat with a cup holder 924 in the arm rest 922. The user may grasp the pull tab 234 and extend the extendable base 200 downwards. The popcorn container 900 may be placed on top of the arm rest 922 with the extendable base 200 extending down into the cup holder 924 such that the popcorn container 900 is prevented from tipping or sliding off of the arm rest 922.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used herein, the words "couple", "couples", "coupled" or "coupling", may refer to connecting, either directly or indirectly, and does not necessarily imply a mechanical connection.

As used herein, "deploy" may refer to configuring a device to place the device into service or to make the device ready for service. As non-limiting examples, "deployed" may be synonymous with extended, unfolded, inflated, erected, unwound, or activated. As non-limiting examples, a device that is not deployed may be referred to as retracted, folded, deflated, withdrawn, collapsed, stowed, wound, or deactivated.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, "frustum" may refer to a portion of a solid that lies between two parallel planes that intersect with the solid.

As used in this disclosure, "horizontal" may be a directional term that refers to a direction that is perpendicular to the local force of gravity. Unless specifically noted in this disclosure, the horizontal direction is always perpendicular to the vertical direction.

As used in this disclosure, the term "intermediate" may refer to a location that lies between a first object and a second object As used herein, "living hinge" may refer to a single object that is formed out of elastomeric material that is divided into a first segment, a second segment, and a hinge segment between the first segment and the second segment where the material comprising the hinge segment is thinner than the material comprising the first segment and the second segment. The elastic nature of the elastomeric material allows the living hinge to be flexed in the manner of a hinge allowing the first segment to move relative to the second segment.

As used in this disclosure, "nested" may refer to a relationship between two or more objects contained within a collection wherein any first object selected from the collection either: 1) contains within it a second object selected from the collection; 2) is contained within a second object selected from the collection; or, 3) contains within it a second object selected from the collection and is contained within a third object selected from the collection.

As used in this disclosure, a "rim" may be an outer edge or border that follows along the perimeter of an object.

As used in this disclosure, a "tab" may be an extension of an object for the purpose of facilitating the manipulation of the object, identifying the object, or attaching the object to another object.

As used in this disclosure, "telescopic", "telescoping", and "telescopically" may refer to an object made of two or more sections that fit or slide into each other such that the object can be made longer or shorter by adjusting the relative positions of the sections.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIG. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A popcorn bag cup holder insert comprising:

an extendable base, a top panel, and a bottom panel;

wherein the top panel adheres to the underside of a popcorn container to hold the popcorn bag cup holder insert onto the popcorn container;

wherein the extendable base comprises a plurality of collapsible sections that convert between a collapsed configuration and an extended configuration;

wherein in the extended configuration, the extendable base is inserted into a cup holder of an arm rest in order to retain the popcorn container on the arm rest;

wherein a pull tab located on the bottom panel is adapted to be grasped and pulled by a user to move the plurality of collapsible sections from the collapsed configuration to the extended configuration.

2. The popcorn bag cup holder insert according to claim 1 wherein the extendable base comprises the plurality of collapsible sections that are deployed to the extended configuration in order to form an insert for the cup holder;

wherein the extendable base resembles a frustum of a cone when in the extended configuration.

3. The popcorn bag cup holder insert according to claim 2 wherein the plurality of collapsible sections are hollow such that the plurality of collapsible sections telescopically collapse to form the collapsed configuration.

4. The popcorn bag cup holder insert according to claim 3 wherein the plurality of collapsible sections are movably coupled by a plurality of section couplers.

5. The popcorn bag cup holder insert according to claim 4 wherein the plurality of collapsible sections comprise a top section, one or more intermediate sections, and a bottom section;

wherein the top section has the largest diameter of the plurality of collapsible sections;

wherein the diameters of the plurality of collapsible sections decrease sequentially at lower levels of the plurality of collapsible sections;

wherein the bottom section has the smallest diameter.

6. The popcorn bag cup holder insert according to claim 5 wherein the extendable base adjusts to the size of the cup holder by virtue of pulling more or fewer of the plurality of collapsible sections downward.

7. The popcorn bag cup holder insert according to claim 5 wherein the top panel covers the top of the top section such that the top of the top section is closed;

wherein the top panel forms a horizontal surface that is coupled to the bottom of the popcorn container.

8. The popcorn bag cup holder insert according to claim 7 wherein the top surface of the top panel comprises an adhesive layer that is operable to couple the top panel to the popcorn container.

9. The popcorn bag cup holder insert according to claim 8 wherein the adhesive layer is covered by a backing liner that covers the adhesive layer;

wherein the backing liner is removed to expose the adhesive layer.

10. The popcorn bag cup holder insert according to claim 8 wherein the one or more intermediate sections couple the top section to the bottom section such that the plurality of collapsible sections telescopically collapse and extend.

11. The popcorn bag cup holder insert according to claim 10 wherein the bottom panel covers the bottom of the bottom section such that the bottom of the bottom section is closed.

12. The popcorn bag cup holder insert according to claim 11 wherein the bottom panel comprises the pull tab that is adapted to be grasped and pulled by the user while extending and/or collapsing the extendable base.

13. The popcorn bag cup holder insert according to claim 12 wherein the plurality of collapsible sections are movably coupled by the plurality of section couplers;

wherein two adjacent sections selected from the plurality of collapsible sections are coupled by an individual section coupler such that a lower section moves axially relative to an upper section.

14. The popcorn bag cup holder insert according to claim 13 wherein the individual section coupler is a living hinge that couples the bottom of the upper section to the top of the lower section.

15. The popcorn bag cup holder insert according to claim 13 wherein in the extended configuration, the lower section is positioned below the upper section with the individual section coupler extending down from a bottom rim of the upper section to an upper rim of the lower section.

16. The popcorn bag cup holder insert according to claim 15 wherein in the collapsed configuration, the lower section is positioned at least partially within the upper section with the individual section coupler extending up from a bottom rim of the upper section to an upper rim of the lower section.

17. The popcorn bag cup holder insert according to claim 16 wherein in the extended configuration, the plurality of collapsible sections are unnested such that the extendable base achieves maximum vertical height;

wherein in the collapsed configuration, the plurality of collapsible sections are nested such that the extendable base achieves minimum vertical height.

18. The popcorn bag cup holder insert according to claim 17 wherein there are three collapsible sections comprising the top section, one intermediate section, and the bottom section.

19. The popcorn bag cup holder insert according to claim 17 wherein the popcorn bag cup holder insert is coupled to the popcorn container prior to distribution such that the popcorn container and the popcorn bag cup holder insert are distributed as a single unit.

20. The popcorn bag cup holder insert according to claim 17 wherein the popcorn bag cup holder insert is distributed separately from the popcorn container such that the popcorn bag cup holder insert is coupled to the popcorn container at the time of use.

* * * * *